US006902078B2

(12) United States Patent
Fiorentini

(10) Patent No.: US 6,902,078 B2
(45) Date of Patent: Jun. 7, 2005

(54) CANS FOR CARBONATED AND NON-CARBONATED BEVERAGES, CLOSURE SYSTEMS FOR THEM AND METHOD TO OPEN THE CANS

(76) Inventor: Graziella Fiorentini, Via delle Fornaci, 131, Rome (IT)

( * ) Notice: Subject to any disclaimer, the term of this patent is extended or adjusted under 35 U.S.C. 154(b) by 90 days.

(21) Appl. No.: 10/471,423

(22) PCT Filed: Mar. 7, 2002

(86) PCT No.: PCT/IT02/00143

§ 371 (c)(1),
(2), (4) Date: Sep. 11, 2003

(87) PCT Pub. No.: WO02/072432

PCT Pub. Date: Sep. 19, 2002

(65) Prior Publication Data

US 2004/0112898 A1 Jun. 17, 2004

(30) Foreign Application Priority Data

Mar. 12, 2001 (IT) ..... RM20010045 U

(51) Int. Cl.[7] ..... B65D 17/34
(52) U.S. Cl. ..... 220/269; 220/906
(58) Field of Search ..... 220/269, 270–273, 220/257.2, 906, 258.2, 258.5, 265

(56) References Cited

U.S. PATENT DOCUMENTS 3,773,210 A * 11/1973 Radtke ..... 220/273
3,952,914 A * 4/1976 Vogt ..... 220/825
4,108,330 A * 8/1978 Patterson ..... 220/260
4,189,060 A * 2/1980 Trotman, III ..... 220/260
4,463,866 A 8/1984 Mandel
4,572,398 A * 2/1986 Juty ..... 220/271
4,915,290 A * 4/1990 Robichaud et al. .... 229/125.08
5,775,534 A * 7/1998 Webb et al. ..... 220/269
6,062,414 A * 5/2000 Mongarli et al. ..... 220/269
6,460,719 B1 * 10/2002 Finmark ..... 220/258.5

FOREIGN PATENT DOCUMENTS

WO WO 00/68092 11/2000
WO WO 01/00495 1/2001

* cited by examiner

*Primary Examiner*—Lien M. Ngo
(74) *Attorney, Agent, or Firm*—Young & Thompson

(57) ABSTRACT

A can for carbonated and non-carbonated beverages provided with an opening system comprising a tearable tongue (22) defined by a tearing invitation score line in the outer surface of the upper wall of the can and with a tearing device associated to the tearable tongue and aimed at tearing the tearable tongue and at opening the can. The tearing device for the tearable tongue (22) is comprised of two tongues superimposed to one another, a first tongue (30) attached to the outer surface of the upper wall of the can, intended to tear the tearable tongue (22) outwardly of the can, and a second tongue (31), attached to the tearable tongue (22), intended to start tearing of the tearable tongue (22) inwardly of the can.

11 Claims, 2 Drawing Sheets

Figure 1:
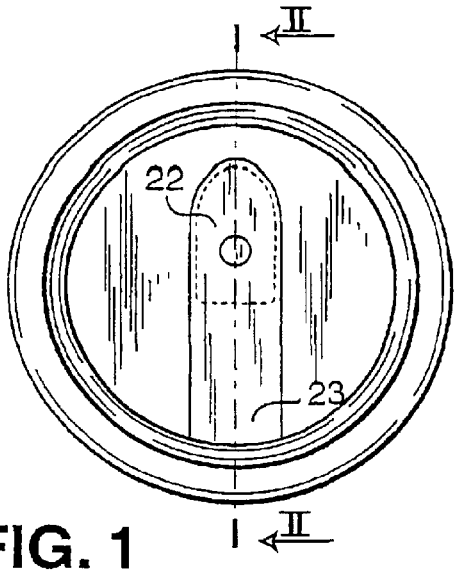

CANS FOR CARBONATED AND NON-CARBONATED BEVERAGES, CLOSURE SYSTEMS FOR THEM AND METHOD TO OPEN THE CANS

This invention broadly relates to cans for supplying carbonated and non-carbonated beverages and more particularly it concerns some improvements to enable not only the opening operations of the cans to be more effectively carried out, but also to solve the two main problems raised by popular diffusion of this type of beverage containers.

As it is known, the cans are presently the most popular means for retail sale of various beverages, in view of the transport ease as well as of the low manufacturing cost of them. Such containers are realised by a thin metal plate and are distributed on sale in tightly closed condition, so that opening thereof requires tearing of a portion of the wall of the container itself, usually at its upper surface, by means of a tongue that is provided with a slight score line aimed at aiding its tearing and with a small ring attached to the tearing tongue.

As the use of containers of this type became more and more popular, a problem of hygienic character was raised due to the fact that, after their manufacture and after filling or even during their shipping to the various distribution stations, such cans are usually maintained in stores that do not offer any hygienic or safety guarantee. When one considers that very rarely such cans can be washed before opening and that sometimes, after opening, they are brought in direct contact with the mouth of the consumer for drinking the content, it can be understood that the consumer runs a high risk of infection.

A first aspect of this invention, therefore, is to guarantee an hygienic use of the cans.

Since, together with the well known plastic bags, such cans represent a product that causes a noticeable contribute to environment contamination in view of their diffusion, particularly in connection with their opening tongue that, upon detaching thereof, is usually left lying around, a second aspect of this invention is to provide an opening system that does not entail the possibility to free and to detach tongues amenable to be abandoned also in potentially dangerous places, such as the sand of a beach, where they remain at hand of each child unaware of the danger.

With reference to this aspect, a subordinate problem, which is raised regardless of the fact that such tongues are disadvantageously realised with detachable construction, is due to the fact that such opening tongues, as above mentioned, are opened by a tearing operation aided by a slight score cut in the thickness of the can thin plate in the area of the can cover. This entails that the edge of the torn tongue as well as the edge of the aperture left in the cover after removal of the tongue unavoidably have tiny burrs that are very sharp. Even if this consequence can be of scarce relevance in respect of the can cover aperture, it can be extremely dangerous in respect of the tongue itself, that, upon detachment from the can, is to be considered as a sharp cutting and very dangerous waste item.

All these issues are addressed by Italian Utility Design Application No. RM99U000099, filed on May 7, 1999, by the same Applicant that, in its preferred embodiment, comprises a can for carbonated and non-carbonated beverages provided with an opening system comprising an opening device with a tearable tongue defined by a tearing invitation score line in the outer surface of the upper wall of the can and with a tearing device associated to said tearable tongue and aimed at tearing said tearable tongue and at opening the can, wherein said tearing device for the tearable tongue includes a second additional tongue, integrally connected to said tearable tongue and unremovably fixed to said can, so as to avoid that both said tongues be detached from the can, said additional tongue has a shape corresponding to the shape of said tearable tongue and slightly larger perimetral dimensions, in order to cover the possibly sharp tearing edges of said tearable tongue.

It has been found that a closure device for cans as disclosed in the above mentioned patent application has some drawbacks due to the difficulty to carry out tearing of said tearable tongue without realizing a preliminary score line to aid starting the tearing action.

It is a specific object of this invention to provide a closure structure for cans wherein said drawback is overcome and opening of the can is performed by suitably starting the tearing action on the tearable tongue.

This object is achieved by means of an opening system for cans wherein the tearing device for tearing said tearable tongue is comprised of two tongues superimposed to one another, a first tongue attached to the outer surface of the upper wall of the can, intended to tear said tearable tongue outwardly of said can, and a second tongue, attached to said tearable tongue, intended to start tearing of said tearable tongue inwardly of the can.

Further particulars and advantages as well as characteristics and construction details will be evident from the following description with reference to enclosed drawings wherein the preferred embodiment is shown by way of illustration and not by way of limitation.

Figure 2:
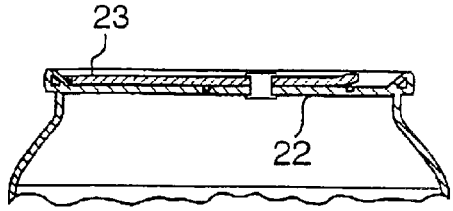
Figure 3:
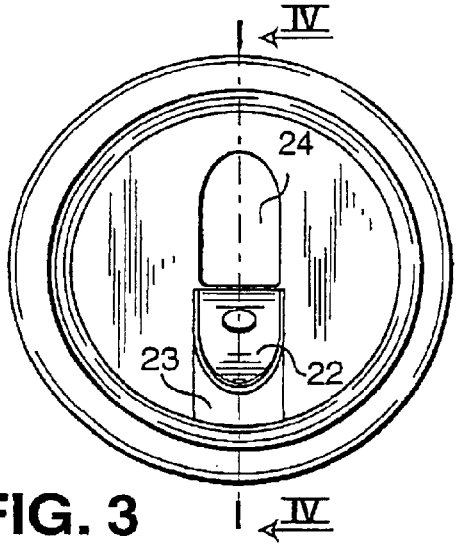
Figure 4:
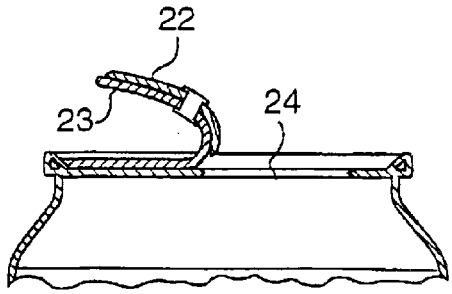
Figure 5:
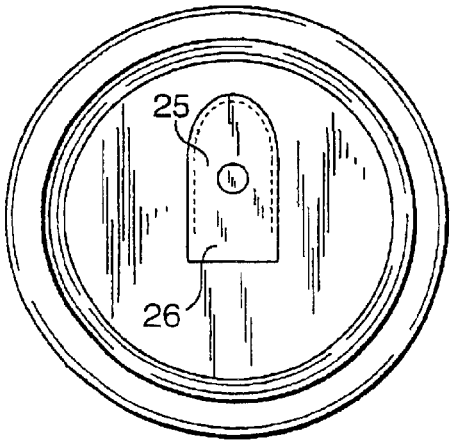
Figure 6:
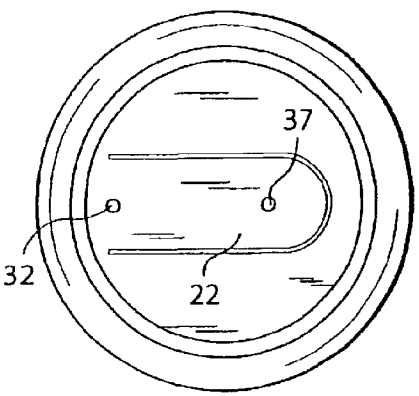
Figure 7:
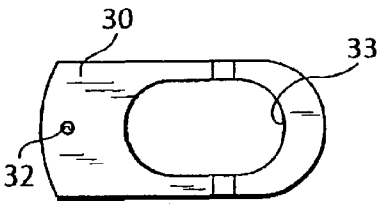
Figure 8:
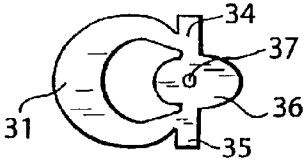
Figure 9:
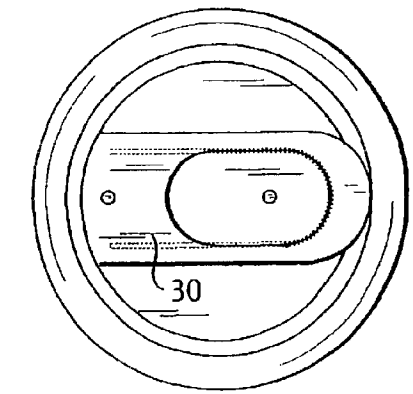
Figure 10:
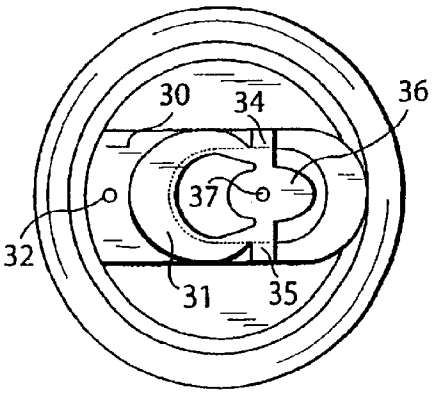
Figure 11:
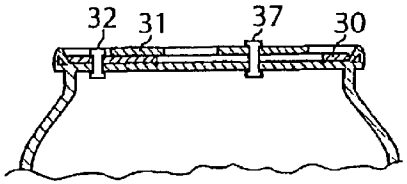
Figure 12:
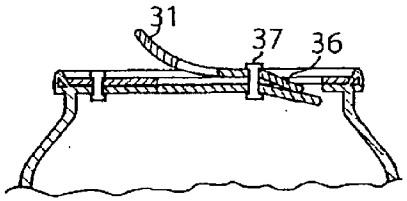
Figure 13:
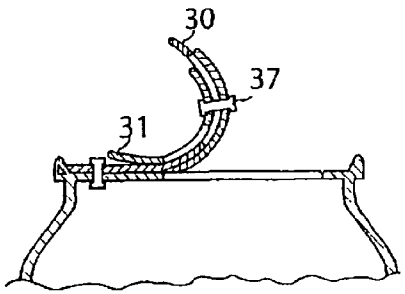

In the drawings:

FIG. 1 shows a plan upper view of a system for opening the tearable tongue according to the above mentioned Utility Design Application, FIG. 2 shows a partial cross-section view taken along line II—II of FIG. 1, FIG. 3 shows a plan upper view of the can of FIG. 1 in open condition, FIG. 4 shows a partial cross-section view taken along line IV—IV of FIG. 3, FIG. 5 shows a plan upper view of a can with an opening system for the tearable tongue similar to the one shown in FIGS. 1–4, FIG. 6 shows an upper plan view of a can having a tearable tongue scored in its upper wall according to this invention, FIG. 7 shows an upper plan view of a ring like tearing tongue designed for attachment to the can of FIG. 6, FIG. 8 shows an upper plan view of a ring like tongue intended to start tearing of the tearable tongue from the can of FIG. 6, FIG. 9 shows an upper plan view of the can of FIG. 6 after the ring like tearing tongue shown in FIG. 7 has been attached, FIG. 10 shows an upper plan view of the can of FIG. 6, in finished condition, after both ring like tongues of FIGS. 7 and 8 have been attached, and FIG. 11 shows an axial cross-section view of the can of FIG. 10 in closed condition, FIG. 12 shows an axial cross-section view of the can of FIG. 10 in a position in which the tearing starting tongue is operated, FIG. 13 shows an axial cross-section view of the can of FIG. 10 in the opening condition, after both the tearing starting ring like tongue of FIG. 8 and the tearing ring like tongue of FIG. 7 have been operated.

By referring now to FIGS. 1–4 of the annexed drawings, it can be observed that the construction disclosed in the above mentioned Utility Design Application is shown by way of illustration, as an attempt to solve the above discussed problems of the environment prejudice and of the dangers connected with the sharp edge of the tearable tongue in conventional cans.

It has been stressed that, aiming at preventing that, upon opening the can, the tearable tongue be unproperly abandoned and become not only a danger, but also an environment contamination, even assuring that the can is excellently open, it is necessary that the tongue is not detached from the can and it is not left lying around.

Furthermore, as above said, should even the tongue be completely detached and even more should it be left attached to the can, it is absolutely necessary that all unavoidable tiny and sharply cutting burrs formed by the tearing action do not represent a cutting danger for the hands and even more for the mouth of all those consumers who, regardless of any aesthetic consideration, wish to use the opened can as a drinking glass.

By specifically referring to FIGS. 1–4, it can be observed that a second additional tongue 23 is superimposed and attached upon said first tearable tongue 22, scored on the upper surface of the can, said second tongue 23 being characterised in that it is unremovably attached to the can and in that it has perimetral dimensions slightly larger than the dimensions of the tearable tongue 22.

In FIG. 1, the tearable tongue 22 is shown in dashed line and it is completely removable, so as to completely open a hole 24 as illustrated in FIGS. 3 and 4, for accessing the beverage contained in the can.

In FIG. 5, the tearable tongue 25 is again shown in dashed line, but it is not completely removable: it can be only partially raised, because it is realised by a partial score line in the upper surface of the can. In any case, it has dimensions smaller than the dimensions of the superimposed or additional tongue 26, which is anyway unremovably attached to the can.

The rigid connection between the two tongues is realised by means of a technique selected among spot welding, line welding, pressure or cold upsetting, thermocompression or glueing, so as to guarantee in any case a suitable tearing of the tearable tongue.

In this structure, two essential characteristics are to be remarked because two completely novel and advantageous effects can be obtained therefrom.

In the first place, when the can is opened, the tearable tongue 22 or 25 is never completely detached from the can, in view of the fact that it remains affixed to the additional tongue 23 or 26 which, in turn, is unremovably attached to the can. By this means, it is possible to eliminate the risk that the tearable tongue is completely detached and left lying around.

In the second place, since the tearable tongue has dimensions smaller than the dimensions of the additional tongue, all sharp edges caused by the tearing action thereof are always located inwardly with respect to the edges of the additional tongue which are blunt and not dangerous and, therefore, such sharp and cutting edges are covered and "protected", thereby eliminating any risk that the users of the can be accidentally injured.

Aiming at overcoming any possible difficulties on starting the tearing action of said tearable tongue, this invention proposes a solution as shown in FIGS. 6–12.

By referring to FIG. 6, it can be observed that the upper wall of the concerned can has a tongue 22 scored or partially cut through the thickness of the wall and consequently tearable from said wall. Such tongue is strictly similar to the tearable tongue of FIGS. 1 to 5 and, therefore, it can be partially or completely removed from the can wall. Broadly it has an elongated shape with an end apex point at which the tearing action to open the can could be most easily started.

According to this invention, the opening system for the can, namely, in effect, the system for tearing and lifting said tongue 22, comprises the combination of two ring like tongues, one of which, namely 31, as shown in FIG. 8, is designed to start tearing of the tearable tongue 22 inwardly of the can, while the other one, namely tongue 30, as shown in FIG. 7, is designed to prosecute tearing of said tearable tongue 22 in opposite direction, outwardly of the can.

The tearing tongue 30 of FIG. 7 has a ring like elongated shape, with a hole 33 having a profile corresponding to the shape of the tearable tongue 22 scored in the outer surface of the upper wall of the can and two side segments. Tearing tongue 30 can be attached to the upper wall of the can at a point 32 by means of any one of the well known systems as mentioned in the previous patent application. The outer dimensions of this tearing tongue are larger than the outer dimensions of said tearable tongue 22, so as to protect the user against any contact with its outer sharp edge.

The tearing starting tongue 31 as shown in FIG. 8 has a ring like shape, with two tabs 34 and 35 that can be overlaid to the side segments of said tearing tongue 30 of FIG. 7, as well as a beak point portion 36 adapted to act upon the front edge of the tearable tongue 22 scored in the outer surface of the upper wall of the can. Said tongue 31 can be attached to the upper wall of the can at a point 37, at a position approximately corresponding to said two tabs 34 and 35, by means of any one of the systems mentioned in the previous patent application.

The logic order for assembling the two tabs system provides for the tearing tongue 30 to be attached to the upper wall of the can at point 32 and for the tearing starting tongue 31 to be applied upon the tearing tongue and to be attached to upper wall of the can at point 37. This arrangement is substantially illustrated in the cross-section view of FIG. 11.

As it can be observed, the attachment point 37 of tongue 31 to the can is aligned with and intermediate between the ring like portion and its beak point portion 36. Therefore, the combination of said two tabs 34 and 35 acting on the side segments of the underlying tongue 30 and of said attachment point 37 forms the fulcrum of a centrally fulcrumed lever.

When the opening procedure is started by lifting the ring like portion of said tearing starting tongue 31 and by rotating the tongue from the center point outwardly, from the center to the periphery, its front beak like point portion 36 pushes the tearable tongue 22 scored in the upper wall of the can inwardly and, therefore, it starts tearing thereof. Upon starting the tearing, the tearing tongue 30 can be utilized, by acting inwardly from the periphery to the center, in order to complete tearing of the tearable tongue 22 and opening of the can. The open condition is shown in the cross-section view of FIG. 12.

From an operational and functional view point, it should be underlined that, in view of its function as a tearing starting member, it is convenient that the material of said tongue 31 be more rigid and mechanically stronger than the material of said tongue 30, which is only designed to prosecute tearing of the tearable tongue 22, as already started by said tearing starting tongue 31.

From the above, it is apparent that, for the discussed steps of starting and completing the tearing of the tearable tongue 22 to be successfully carried out, it is very important that the end apex point of the tearable tongue 22, the attachment point 37 of the tearing starting tongue 31 and the attachment point 32 of said tearing tongue 30 be aligned and that said attachment point 37 be intermediate between said apex point of the tearable tongue 22 and said attachment point 32 of the tearing tongue 30.

As above mentioned, the illustrated assembling order is only a logic order, but it is not necessarily a time order, which means that the two tongues 30 and 31 can also be previously assembled together, by attaching the two side tabs 34 and 35 of tongue 31 to the side segments of tongue 30 and thereafter by attaching the combination of said tongues 30 and 31 to the surface of the upper wall of the can at the two attachment points 32 and 37.

Furthermore, particularly in connection with the illustrations of FIGS. 11, 12 and 13, it should be understood that they are purely illustrative and schematic, so that they do not illustrate exact thicknesses and exact height relationships and exact spatial superposition of the thicknesses, since these details can be perfectly designed by those skilled in the art.

A further advantage of the construction as above described and illustrated is that, upon opening the can by operating tongues 30 and 31 in the already explained way, it is possible to again close the can, even if in not tight manner, by inversely bending the concerned two tongues 30 and 31 and, consequently, the tearable tongue 22, so as to at least cover the hole formed in the upper wall of the can.

The preferred embodiments of this invention have been described and a number of variations have been suggested hereinbefore, but it should expressly be understood that those skilled in the art can make other variations and changes to the details and to the construction particulars and can exploit all construction and operation features as above described and as shown in the enclosed drawings, individually or in any combination thereof, without so departing from the scope of this invention.

What is claimed is:

1. A can for carbonated and non-carbonated beverages provided with an opening system comprising a tearable tongue (22) defined by a tearing invitation score line in the outer surface of the upper wall of the can and having an end apex point at which tearing is started and with a tearing device associated to said tearable tongue and aimed at tearing said tearable tongue and at opening the can, characterised in that said tearing device for the tearable tongue (22) is comprised of two tongues superimposed to one another, a first tongue (30) attached to the outer surface of the upper wall of the can, intended to tear said tearable tongue (22) outwardly of said can, and a second tongue (31), attached to said tearable tongue (22), intended to start tearing of said tearable tongue (22) inwardly of the can.

2. The can for beverages according to claim 1, characterised in that said score line by which said tearable tongue is defined is complete, so as to allow a complete detachment of said tearable tongue from said can.

3. The can for beverages according to claim 1, characterised in that said score line by which said tearable tongue is defined is partial, so that it does not allow a complete detachment of said tearable tongue from said can, but only allows it to be lifted.

4. The can for beverages according to claim 1, characterised in that said first tearing tongue (30) has a ring like elongated shape, with a hole (33) having a profile corresponding to the shape of the tearable tongue 22 scored in the outer surface of the upper wall of the can and two side segments.

5. The can for beverages according to claim 4, characterised in that the outer dimensions of said first tearing tongue (30) are larger than the outer dimensions of said tearable tongue (22), so as to protect the user against any contact with its outer sharp edge.

6. The can for beverages according to claim 1, characterised in that a rigid integral connection between the first tearing tongue (30) and the outer surface of the upper wall of the can is realised by means of a technique selected among spot welding (32), line welding, pressure or cold upsetting, thermocompression or gluing, so as to guarantee in any case a suitable tearing of the tearable tongue.

7. The can for beverages according to claim 4, characterised in that said second tearing tongue (31) has a ring like shaped portion, with two tabs (34,35) that can be superimposed to the side segments of said first tearing tongue (30), and a beak point portion (36) adapted to act upon the front edge of the tearable tongue (22) scored in the outer surface of the upper wall of the can.

8. The can for beverages according to claim 7, characterised in that said second tearing tongue (31) is attached to said tearable tongue (22) at a position (37) approximately corresponding to said two tabs (34, 35) and it is realised by means of a technique selected among spot welding, line welding, pressure or cold upsetting, thermocompression or gluing.

9. The can for beverages according to claim 8, characterised in that the attachment point (37) of said second tearing tongue (31) to the can is aligned with and intermediate between said ring like portion and its beak point portion (36), so that it acts as a fulcrum of a centrally fulcrumed lever.

10. The can for beverages according to claim 9, characterised in that the end apex point of the tearable tongue (22), the attachment point (37) of the second tearing tongue (31) and the attachment point (32) of said first tearing tongue (30) are aligned and in that said attachment point (37) of said second tearing tongue is intermediate between said apex point of the tearable tongue (22) and said attachment point (32) of the first tearing tongue 30.

11. A method of opening a can for carbonated and non-cabonated beverages having an upper wall with a center point and a periphery, provided with an opening system comprising a tearable tongue (22) defined by a tearing starting score line in the outer surface of the upper wall of the can and having an elongated shape with an end apex point, characterised in that it comprises the following steps:

providing a first tongue (30) attached to the outer surface of the upper wall of the can at an attachment point (32), providing a second tongue (31) having a ring like portion, superimposed upon said first tongue (30) and attached to said tearable tongue (22) at an attachment point (37) and having a beak like point portion (36), said attachment point (37) of said second tongue being aligned with an intermediate between said end apex point of the tearable tongue (22) and the attachment point (32) of said first tongue (30), starting tearing of said tearable tongue (22) by lifting the ring like portion of said second tongue (31) and rotating it around its attachment point (37) to said tearable tongue (22), from the center point to the periphery of the upper wall of the can, so that its beak like point portion (36) pushes the tearable tongue (22) at its end apex point inwardly of the can, completing tearing of the tearable tongue (22) and opening the can by inversely rotating said first tongue (30) from the periphery to the center point of the upper wall of the can around its attachment point (32) to the upper wall of the can, thereby upwardly pushing said second tongue (31) superimposed thereupon.

* * * * *